United States Patent [19]

Johns

[11] 4,133,589

[45] Jan. 9, 1979

[54] SHOE DISPLAY DEVICE AND METHOD

[76] Inventor: Robert L. Johns, P.O. Box 2897, Vero Beach, Fla. 32960

[21] Appl. No.: 734,250

[22] Filed: Oct. 20, 1976

[51] Int. Cl.[2] ..... A47F 7/08

[52] U.S. Cl. ..... 312/125; 312/324; 211/34

[58] Field of Search ..... 312/125, 234.14, 324, 312/285, 123, 245, 209; 211/34, 36

[56] References Cited

U.S. PATENT DOCUMENTS

| | | | |
|---|---|---|---|
| 142,887 | 9/1873 | Baldwin | 312/209 |
| 264,749 | 9/1882 | Potts | 312/285 |
| 308,431 | 11/1884 | Quayle | 312/209 |
| 369,590 | 9/1887 | Claypool | 312/209 |
| 638,619 | 12/1899 | Barnes | 312/209 |
| 723,661 | 3/1903 | Evans | 312/324 UX |
| 872,043 | 11/1907 | Bower | 211/36 |
| 904,755 | 11/1908 | Cartier | 211/36 |
| 2,357,555 | 9/1944 | Seaton | 312/209 |
| 3,042,978 | 7/1962 | Eames et al. | 312/245 |
| 3,552,576 | 1/1971 | Lahr | 211/36 |
| 3,909,091 | 9/1975 | Tantillo | 312/245 |
| 3,942,852 | 3/1976 | Anthony | 312/234.3 |

FOREIGN PATENT DOCUMENTS

| | | | |
|---|---|---|---|
| 1112555 | 3/1956 | France | 312/324 |
| 744992 | 2/1956 | United Kingdom | 312/324 |

*Primary Examiner*—Victor N. Sakran
*Attorney, Agent, or Firm*—Carroll F. Palmer

[57] ABSTRACT

Shoes are displayed for maximum sales efficiency while mitigating pilferage in a display device that comprises a pair of horizontally rotatable display units each having a front compartment and a rear compartment. Each front compartment has means to display single shoes of pairs in horizontal rows and the rear compartments have storage means to receive the mating shoes out-of-sight behind the displayed shoe. Both display units are trapesoidal in shape, the hinged side being square and the unhinged side angled, permitting the two display units to mesh into a closed position and freely rotate into an open position for access to the hidden shoe mates.

6 Claims, 5 Drawing Figures

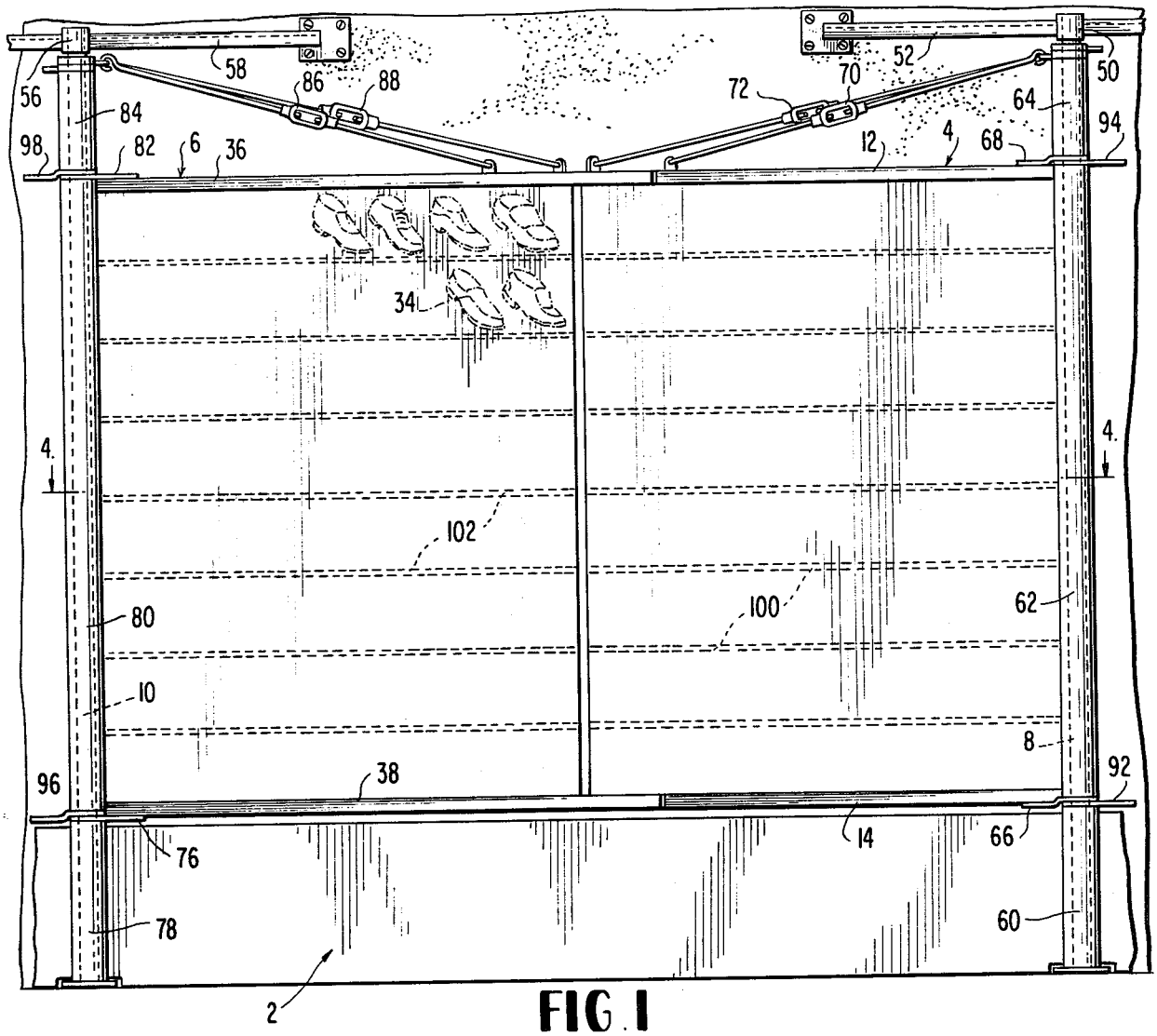
FIG. 1
FIG. 2
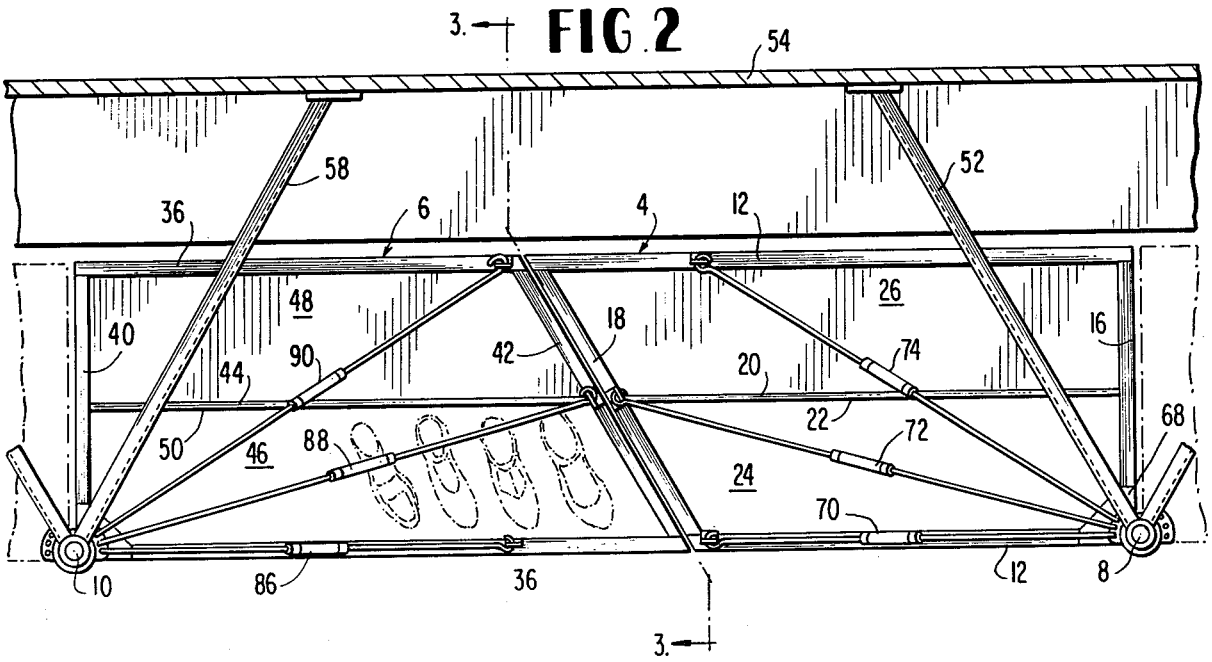

FIG. 3
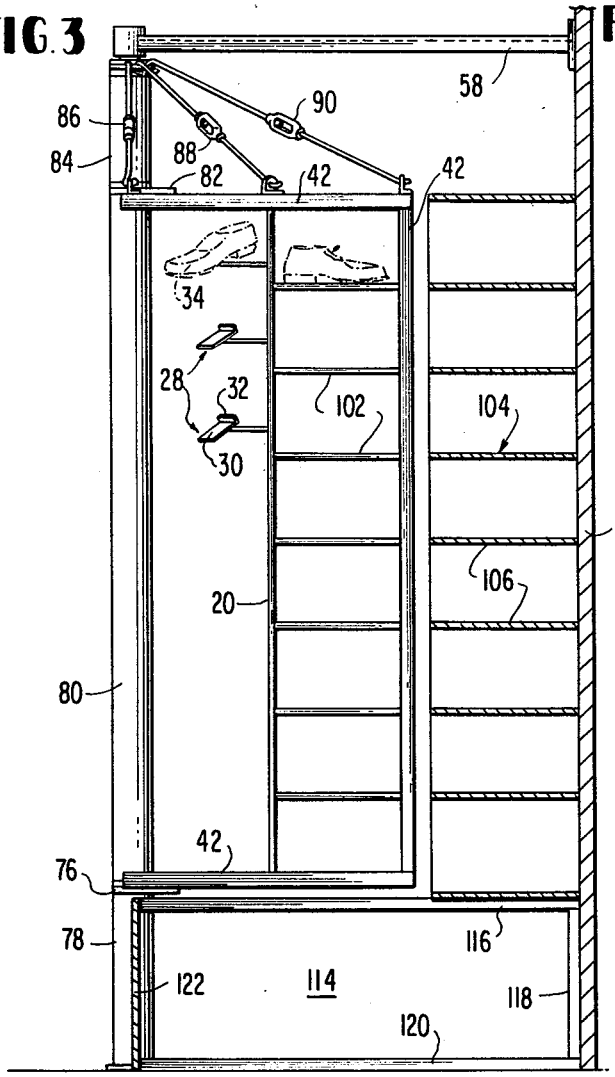
FIG. 5
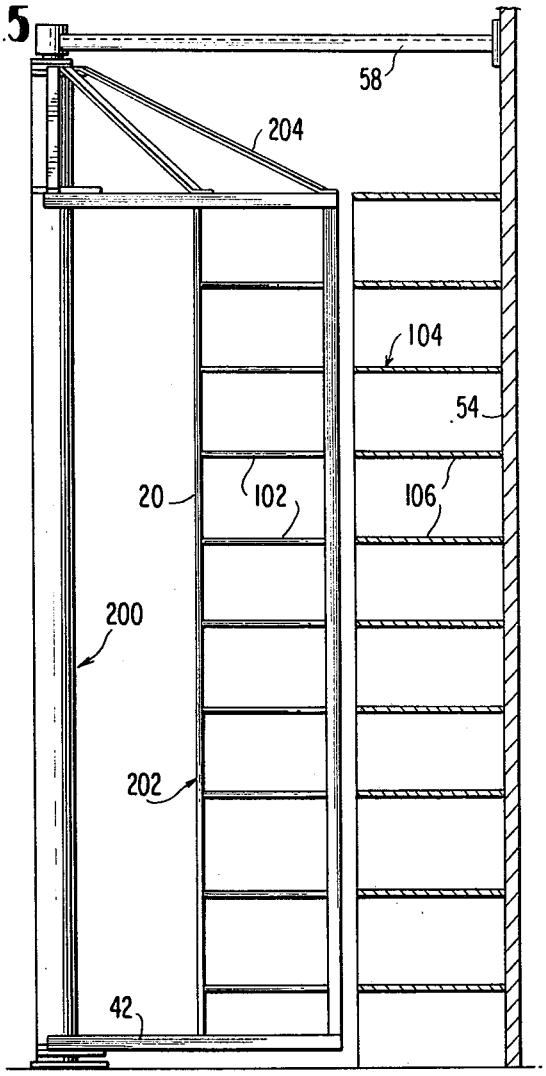
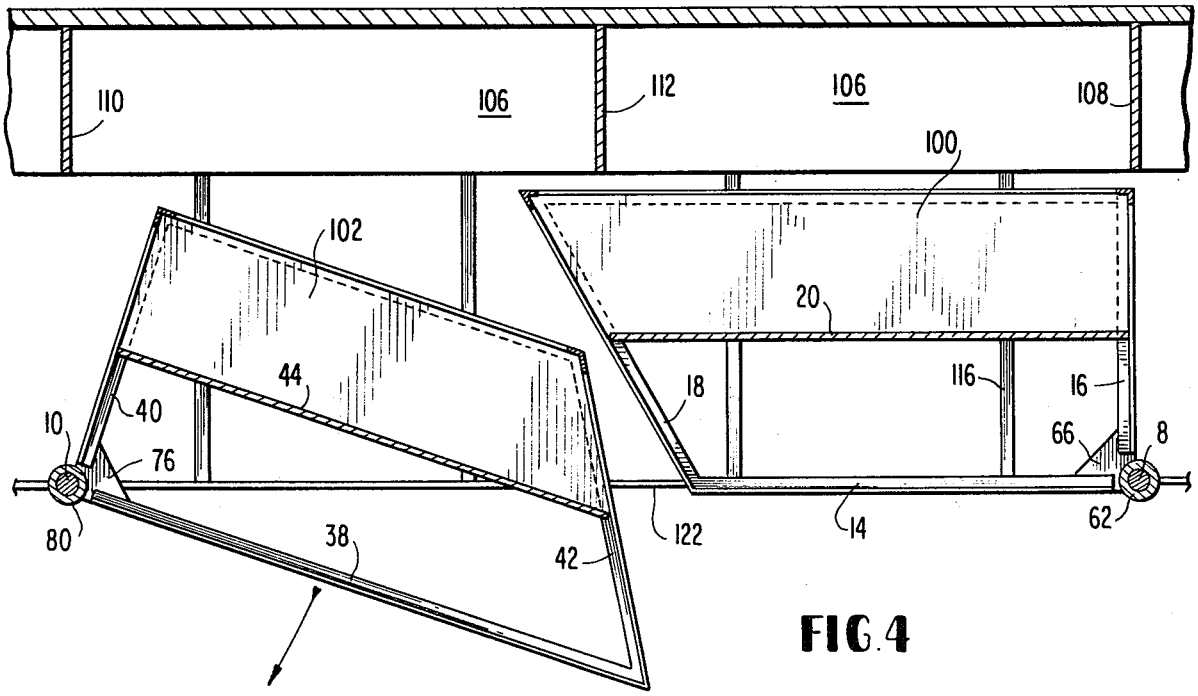
FIG. 4

SHOE DISPLAY DEVICE AND METHOD

BACKGROUND OF THE INVENTION

1. Field of the Invention

This invention relates to shoe display devices designed to maximize the efficient merchandizing of shoes while mitigating shoe pilferage. It also relates to new methods for the display and merchandizing of shoes.

For the sake of brevity, the following description and claims refer specifically to shoes, but the invention broadly relates to other items of equivalent nature sold in pairs including boots, sandals, overshoes, athletic footware, clogs, and the like and the term shoes wherever used herein encompasses such items.

2. Description of the Prior Art

Historically the merchandizing of shoes has been conducted in a sales facility in which customers examine shoes offered by a salesperson upon request. The shoes are usually obtained by the salesperson from a storespace at the back of the salesroom. Such sales methods require an undesireably high ratio of salespersons per customers to handle shoe sales effectively and without customers dissatisfaction with waiting to make a purchase.

Attempts were made to reduce the time required to present a customer with a pair of shoes for size sampling, etc., by providing grouped storage of shoes coupled with a representative visual display of a single representative shoe (see U.S. Pat. No. 1,821,024 and 2,285,491).

Merchandise display and storage units designed to give a degree of security to the stored merchandise together with visual exposure have also been devised which utilize vertically hinged display panels (see U.S. Pat. No. 1,116,817 and 1,678,522).

Self-service merchandizing has for many years presented a technique for increasing sales volume and reducing purchase time without requiring a corresponding increase in salespersons. Self-service sales schemes, however, have proved more useful with certain classes of merchandise than with others. The sale of shoes using self-service principles has been utilized in the past, but has not proved to be totally satisfactory. Open display and ready access by customers to shoes has resulted in substantial inventory "shrinkage" due to pilferage. Special units to display only one shoe of a pair have been designed to mitigate pilferage (see U.S. Pat. No. 3,552,576). However, the prior art display units have been inefficient in salespace and shoe retrieval operation. There exists, therefore, a need for improved shoe display devices that can maximize the efficient merchandizing of shoes for semi-self-service sales while mitigating shoe pilferage.

OBJECTS

A principle object of the present invention is the provision of new forms of shoe display devices.

Further objects include:

1. The provision of shoe display devices suitable for modified self-service merchandizing of shoes.

2. The provision of such display devices that mitigate shoe pilferage.

3. The provision of new methods of merchandizing shoes.

Other objects and further scope of applicability of the present invention will become apparent from the detailed description given hereinafter; it should be understood, however, that the detailed description, while indicating preferred embodiments of the invention, is given by way of illlustration only, since various changes and modifications within the spirit and scope of the invention will become apparent to those skilled in the art from this detailed description.

SUMMARY OF THE INVENTION

The foregoing objects are accomplished according to the present invention by providing a shoe display device that comprises a pair of horizontally rotatable display units each having a front compartment and a rear compartment, each front compartment having means to display single shoes of pairs in horizontal rows and a rear compartment having storage spaces to receive mating shoes behind the displayed shoe. The two display units are trapesoidal in shape with the hinged side being right-angled, one of the unhinged sides being acute angled relative to the front of the unit and the other having a complementary obtuse angle permitting the two display units to mesh into a closed position occupying minimum floor space and to freely rotate into an open position for access to the hidden shoe mates.

The objects are further attained by the method of displaying and merchandizing shoes with the new display devices.

BRIEF DESCRIPTION OF THE DRAWINGS

A more complete understanding of the invention may be had by reference to the accompanying drawings in which:

FIG. 1 is a front elevational view of a shoe display device of the invention.

FIG. 2 is a top plan view of the shoe display device of FIG. 1.

FIG. 3 is side sectional view taken on the line 3—3 of FIG. 2.

FIG. 4 is a top sectional view taken on the line 4—4 of FIG. 1.

FIG. 5 is a side sectional view of a modified form of a shoe display device of the invention.

DESCRIPTION OF THE PREFERRED EMBODIMENTS

The shoe display device 2 comprises a first display unit 4, a second display unit 6 and a pair of vertical shafts 8 and 10.

The first display unit 4 comprises a horizontal top frame 12, horizontal bottom frame 14, a vertical first side frame 16, a vertical second side frame 18 and a vertical central panel 20. The side frame 16 is perpendicular to the central panel 20 and the side frame 18 forms an acute angle with the front 22 of the central panel 20 so that the display unit has a trapesoidal shape.

The central panel 20 divides the display unit 4 into a front compartment 24 and a rear compartment 26. The front compartment 24 is provided with a multitude of shoe support brackets 28 arranged in horizontal rows. Preferably, the brackets 28 comprise a shoe sole support 30 and a heel ledge 32 and are oriented so that shoes 34 are held at an acute angle relative to the central panel 20.

The second display unit 6 comprises horizontal top frame 36, horizontal bottom frame 38, vertical side frames 40 and 42 and central panel 44 that divides the unit 6 into a front compartment 46 and a rear compartment 48. The side frame 40 is perpendicular to the central panel 44 while the side frame 42 forms an obtuse angle with the front 50 of the central panel 44 so that the display unit has a trapesoidal shape. The sum of the acute angle between side frame 18 and central panel 20 and the obtuse angle between side frame 42 and central panel 44 is substantially 180° so the two units can mesh when the units 4 and 6 are in a closed position as shown in FIG. 2.

The vertical shafts 8 and 10 are spaced apart a distance substantially equal to the combined widths of the first unit 4 and second unit 6. The shafts are longer than the height of the units 4 and 6. In the embodiment shown in FIGS. 1–4, the shafts extend substantially above the tops and below the bottoms of the units 4 and 6. The top end 50 of shaft 8 is held in position by brace members 52 that are fastened to a supporting wall 54. Similarly, the top end 56 of shaft 10 is stabilized by brace members 58 that are likewise fastened to the wall 54.

The shaft 8 is encircled by tubular spacers 60, 62 and 64. A hinge 66 is carried by the shaft 8 between spacers 60 and 62 and hinge 68 is similarly carried between spacers 62 and 64. The hinges 66 and 68 are fixed to the bottom and top frames 14 and 12 respectively of the unit 4 permitting the unit 4 to rotate on the shaft 8. Turnbuckle units 70, 72 and 74 are rotatably carried at one end on the shaft 8 above the spacer 64 to assist in supporting the unit 4 on the shaft 8.

The unit 6 is similarly supported on shaft 10 by hinge 76 carried between tubular spacers 78 and 80 and hinge 82 carried between spacers 80 and 84. Turnbuckle units 86, 88 and 90 assist in rotatably supporting the unit 6 on the shaft 10.

The shafts 8 and 10 may support additional display units (not shown) on hinges 92, 94, 96 and 98.

The various frames of units 4 and 6 may be formed of metal channels or straps that are welded or otherwise fastened together. Plastic or wood members may be used in place of metal. Alternatively, sheets of plywood, pressed board or the like may be used in place of metal frames and the term "frames" as used herein is intended to encompass all of these alternatives.

The rear compartment 26 is divided into a multitude of storage spaces by the horizontal shelves 100. Likewise, rear compartment 48 has a plurality of horizontal shelves 102. If desired, the rear compartments can be further divided into pigeon-holes by vertical dividers (not shown). Preferably the shoe support means 28 are positioned in horizontal rows and the shelves 100 and 102 are arranged to correspond in number and spacing to the rows of support means 28.

The depth of the display units 4 and 6 can be approximately equal to the spacing of the shafts 8 and 10 from support wall 54 so that the back of the rear compartments 26 and 48 will adjoin the wall 54 when the units are in the closed position. Advantageously, however, the display device 2 has a third compartment 104 positioned between the wall 54 and the units 4 and 6. The compartment 104 is divided by the horizontal shelves 106 into a number of separate storage spaces, preferably corresponding in number to the shelves 100 and 102. The third compartment may include vertical sides 108 and 110 and vertical center piece 112.

The rectangular storage space 114 extends beneath the display units 4 and 6 and the third compartment 104. It comprises metal frame members 116, 118 and 120. The front is closed by the front panel 122. Access to the storage space 114 is from above when the display units 4 and/or 6 are swung into the open position. Alternatively, the storage space 114 may be constructed as pull-out drawers (not shown).

The functional display device as above described should be provided at the front with an aesthetic facing in the nature of a housing for the device. This will be designed to harmonize with the decor of the salesroom in which the display device is used. Such a facing (not shown) would serve to hide the supports and braces from view when the units 4 and 6 are in the closed position. Such facing would also serve to hide the spacers 60–64 and 78–84 and related hardware to provide a finished appearance to the shoe display.

In the alternative form of the device 200 shown in FIG. 5, the rotating display unit 202 extends almost to the floor so that there is no storage space similar to space 114 as previously described. Also strap trusses 204 are used to assist in supporting the unit 202 instead of turnbuckle units as with the display device 2.

The display devices as described provide a new method of displaying and selling shoes in an efficient manner and with a minimum of pilferage. One shoe 34 of a pair is placed in an angled position upon a support means 28 while the second shoe of the pair is placed behind the first in the rear compartment. This is repeated until the units 4 and 6 have been filled with shoes. The units are then rotated into the closed position as shown in FIG. 2. Customers may view all of the shoes to make a selection and even try one or more of the displayed shoes for size and fit without assistance from a salesperson. When the customer has decided upon a particular shoe, the mate can then immediately be obtained by a salesperson simply by rotating the display unit into an open position. As shoes are sold, they may be replaced in the display from those stored in the back compartment 104 or the floor storage space 114. As a result, customers can make purchases promptly even with a minimum of salespersons. At the same time, shoe pilferage is reduced with a semi-self-service arrangement because mating shoes are not exposed to the customer.

The embodiments of the invention in which an exclusive property or privilege is claimed are defined as follows:

1. An open front shoe display device to maximize the efficient merchandizing of shoes while mitigating pilferage which comprises:

a first display unit comprising horizontal top and bottom frames, a vertical central panel, a vertical first side frame and a vertical second side frame, said first side frame being perpendicular to said central panel, said second side frame forming an acute angle with the front side of said central panel and said central panel dividing said first unit into a first front compartment and a first rear compartment, a second display unit comprising horizontal top and bottom frames, a vertical central panel, a vertical third side frame and a vertical fourth side frame, said central panel and side frames of said second unit being of substantially the same height as the central panel and side frames of said first unit, said third side frame being perpendicular to said second unit central panel, said fourth side frame forming an obtuse angle with the front side of said second unit central panel, the sum of said obtuse angle and said acute angle of said first unit being substantially 180°, said second unit central panel dividing said second unit into a second front compartment and a second rear compartment, a pair of vertical shafts spaced apart a distance substantially equal to the horizontal width of said first unit plus the horizontal width of said second unit, said first display unit being rotatably mounted at the front vertical edge of said first side frame upon one of said shafts, said second display unit being rotatably mounted at the front vertical edge of said third side frame upon the other of said shafts, said first and second rear compartments having means to hold shoes arranged in horizontal rows, and said first and second front compartments having means to hold shoes in display positions in horizontal rows and at an acute angle relative to said central panels comprising shoe sole supports plus heel ledges.

2. The display device of claim 1 wherein said shafts are longer than the height of first and second units and truss members to assist in supporting said units are rotatably carried upon portions of said shafts that extend above said units.

3. The display device of claim 1 that includes a third compartment disposed rearwardly of said shafts a distance about the combined depth of said front and rear compartments.

4. The display device of claim 3 wherein said third compartment is divided into a multitude of storage spaces arranged in horizontal rows.

5. The display device of claim 3 wherein there is a rectangular storage compartment beneath said front, rear and third compartments.

6. The display device of claim 1 wherein there is a rectangular storage compartment beneath said front and rear compartments.

* * * * *